US005181863A

United States Patent [19]

Welsh

[11] Patent Number: 5,181,863

[45] Date of Patent: Jan. 26, 1993

[54] EMI SHIELDING BACKSHELL SYSTEM

[75] Inventor: David E. Welsh, Tustin, Calif.

[73] Assignee: ITT Corporation, Secaucus, N.J.

[21] Appl. No.: 693,129

[22] Filed: Apr. 29, 1991

[51] Int. Cl.[5] ..... H01R 9/03

[52] U.S. Cl. ..... 439/610; 439/275

[58] Field of Search ..... 439/607, 608, 610, 96, 439/89, 98, 274, 275, 108

[56] References Cited

U.S. PATENT DOCUMENTS

| | | | |
|---|---|---|---|
| 3,040,287 | 6/1962 | Agron et al. | 439/275 |
| 3,539,973 | 11/1970 | Antes et al. | 439/608 |
| 3,879,102 | 4/1975 | Horak | 439/89 |
| 4,820,201 | 4/1989 | Van Brunt et al. | 439/610 |

FOREIGN PATENT DOCUMENTS

| | | | |
|---|---|---|---|
| 8705157 | 8/1987 | European Pat. Off. | 439/275 |

*Primary Examiner*—Steven C. Bishop
*Assistant Examiner*—Hien D. Vu
*Attorney, Agent, or Firm*—Thomas L. Peterson

[57] ABSTRACT

A system is provided for mounting shielded cables in a manner to provide good EMI (electromagnetic interference) shielding, which facilitates terminations and enables field replacements. The system includes a backshell housing having a conductive shell (16, FIG. 1) holding an insert, the housing also having a conductive cover (24) that mounts over the rear end of the shell and that has rows of holes (46) that each pass a prepared cable end (44). After the cables are inserted through the cover holes, a ferrule assembly is attached to the cable. The ferrule assembly (60) includes a ferrule (40) crimped to each cable, a conductive elastomeric seal (50) lying closely about each ferrule crimped portion, and a clip (56) with a rear end that abuts the seal. A grating (62) with parallel beams is inserted sideways between ferrule assemblies to organize them into rows and to abut the forward ends of the clips. When the cover is attached to the shell, the clip compresses the seal against the cover and against the ferrule.

13 Claims, 4 Drawing Sheets

FIG. 2
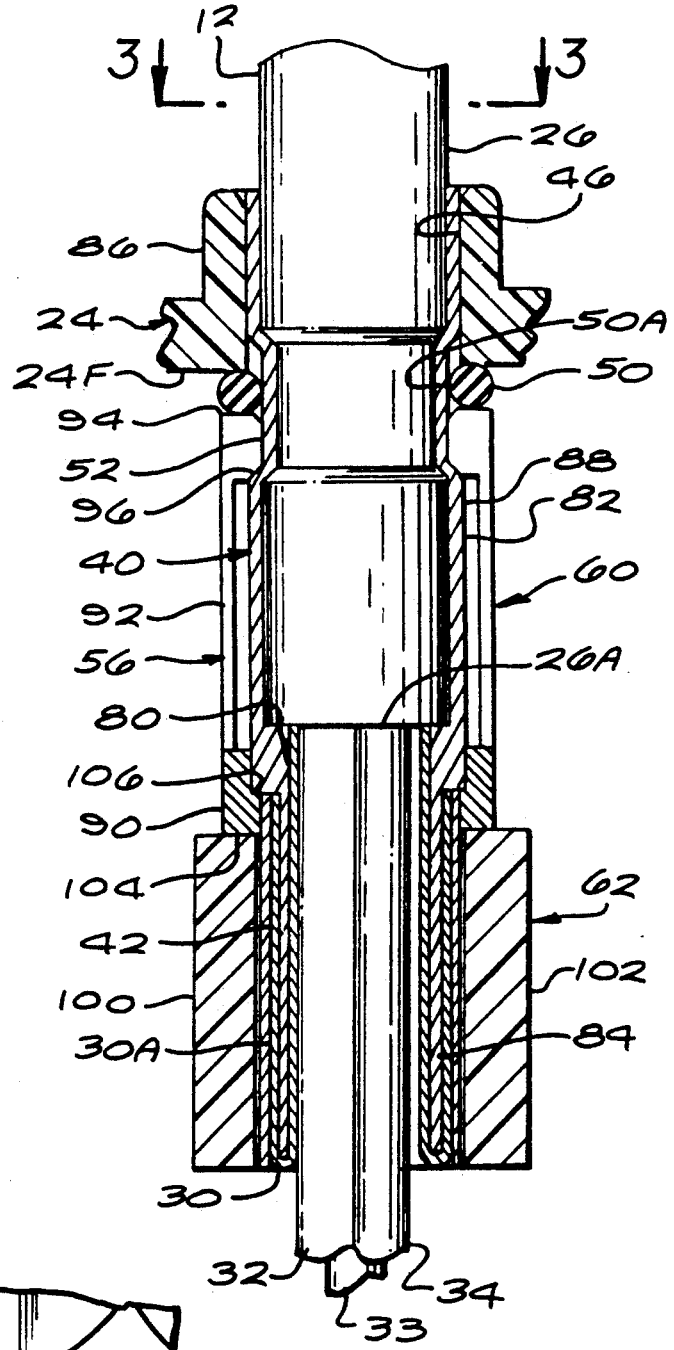
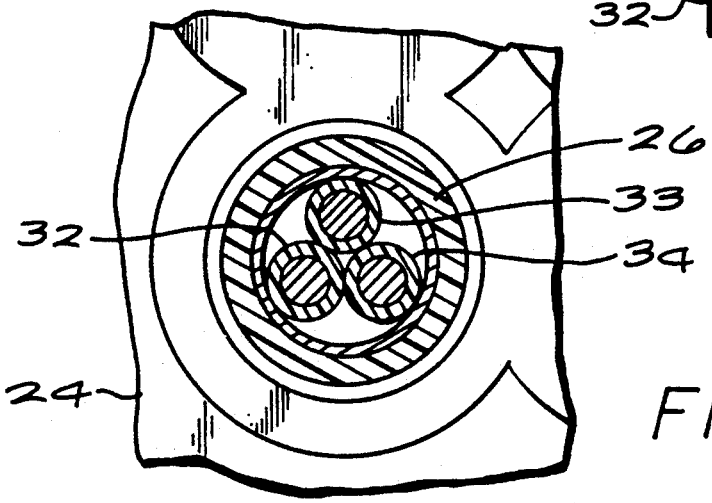
FIG. 3

EMI SHIELDING BACKSHELL SYSTEM

BACKGROUND OF THE INVENTION

Connectors used in environments where EMI (electromagnetic interference) is encountered, or which transmit high frequencies such as 50 MHz or higher, may include many shielded cables. One approach that facilitates wiring of shielded cables, involves installing terminations at the ends of the cable shields for grounding to a conductive shell insert. U.S. Pat. No. 4,820,201 describes a cable terminating method of this type, wherein the cable shield is terminated to a ferrule held by a clip within the connector shell. Replacement of a damaged cable and ferrule assembly requires complete disassembly of the connector, which cannot be readily done in the field. A connector which facilitated installation of shielded cables in a connector and which facilitated replacement of a damaged cable, would be of considerable value.

SUMMARY OF THE INVENTION

In accordance with one embodiment of the present invention, a system is provided for mounting shielded cables, which facilitates their installation and the replacement of a damaged cable end. The system includes a backshell assembly that mounts on a connector, the assembly having a housing with a shell and a cover that mounts over the rear of the shell. The cover has holes through which cables can pass. The system also includes a ferrule assembly comprising a ferrule that surrounds and holds to a cable, and a conductive compressible seal which closely surrounds the ferrule and abuts a front side of the cover. The ferrule assembly also comprises a seal compressing device such as a clip, that is supported against forward movement by the backshell housing, and which presses rearwardly against the seal to compress the seal against the front side of the cover and thereby cause the seal to press radially inwardly against the ferrule. The backshell housing includes a grating with parallel beams that are inserted sidewardly between rows of ferrules to organize forward portions of the ferrules into rows. The grating beams can abut the seal compressing devices that compress the elastomeric seals.

The novel features of the invention are set forth with particularity in the appended claims. The invention will be best understood from the following description when read in conjunction with the accompanying drawings.

BRIEF DESCRIPTION OF THE DRAWINGS

FIG. 2 is an enlarged sectional view of the ferrule assembly of FIG. 1, showing it mounted on the cover and grating of the backshell assembly.

FIG. 3 is a view taken on the line 3—3 of FIG. 2.

DESCRIPTION OF THE PREFERRED EMBODIMENT

Figure 1:
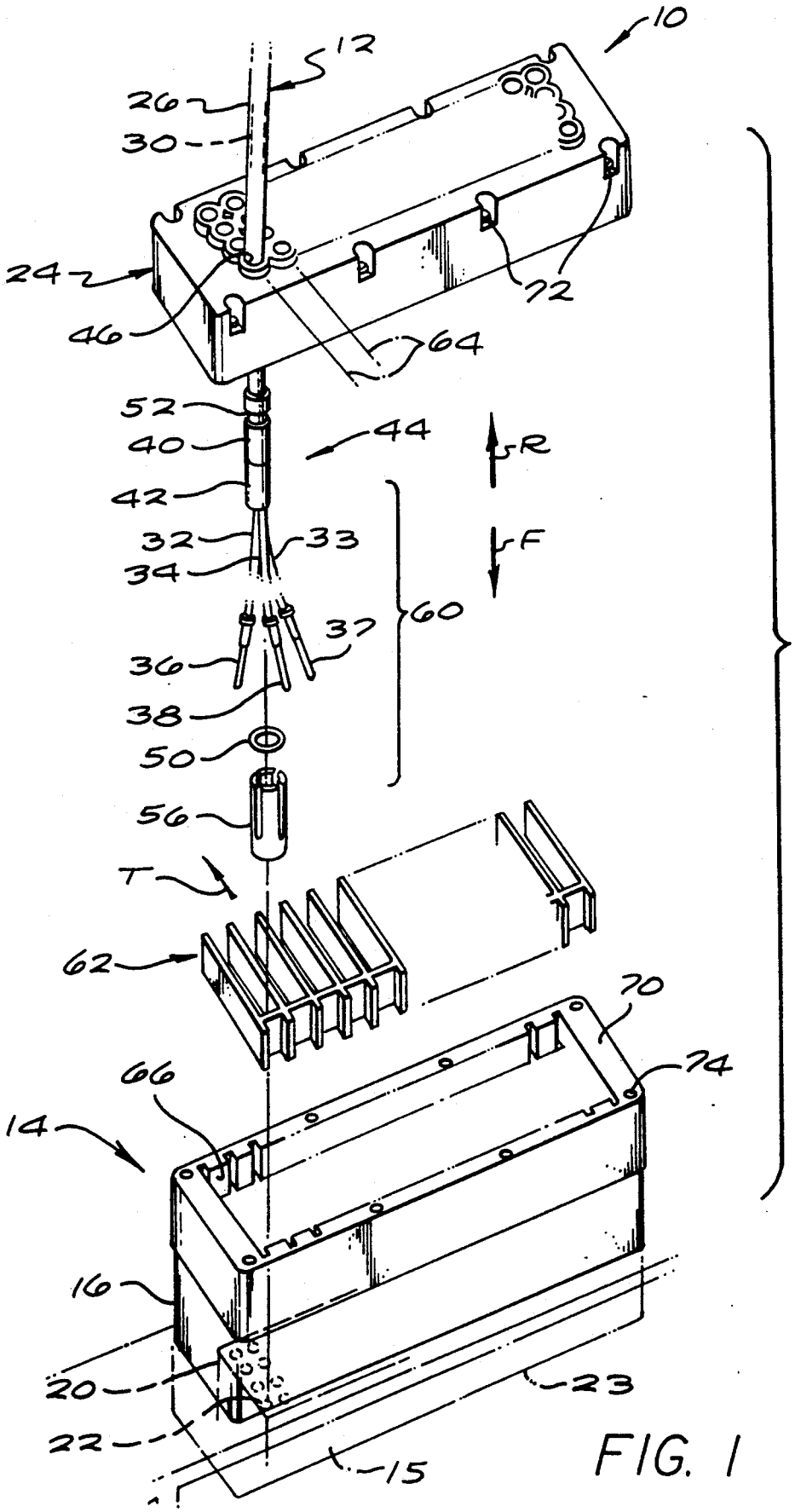
FIG. 1 is a simplified exploded isometric view of a backshell assembly constructed in accordance with the present invention.

FIG. 1 illustrates a backshell assembly 10 which is useful to terminate a large number of shielded cables 12, and which provides EMI (electromagnetic interference) shielding within a connector 15 to which the terminations are made. The backshell assembly includes a housing 14 with a shell 16 that mounts to the connector 15. The connector has a pair of inserts 20 with contact-receiving cavities 22 which lie largely within a connector frame 23. The shell 16 replaces an insert retainer that would otherwise be installed. The backshell housing 14 includes a conductive grounding plate cover 24 that is used to electrically ground the shields of the cables. Each cable includes an insulative jacket 26, a shield in the form of a conductive braiding or tape wrap 30 within the jacket, and one or more wires within the shield, the particular cable shown having three wires 32–34. Each wire has a central conductor surrounded by insulation. The shielded cable is prepared, in that it has contacts 36–38 attached to the conductors of the wires at the forward ends of the wires. Also, a ferrule 40 has been installed on the cable jacket, and a jerk ring 42 has been installed around a forward portion of the ferrule, as will be described below.

To assemble the connector, the prepared shielded cable 44 is inserted in a forward direction F through a hole 46 in the cover. The holes 46 are arranged in rows and columns. Then a conductive compressible seal 50 in the shape of an O-ring is moved rearwardly in the direction R over the prepared cable until the seal lies in a recessed crimped part 52 of the ferrule. After this, a seal-compressing device in the form of a clip 56 is moved in the rearward direction over the cable until it abuts the seal lying in the crimped portion 52 of the ferrule. The ferrule 40, jerk ring 42, seal 50, and clip 56 can all be considered to be part of a ferrule assembly 60. After the ferrule assembly is installed on the cable, and on many other similar cables, the contacts 36–38 of the cable wires are inserted into corresponding cavities 22 in the inserts 20. Then, an organizer grating such as 62 is inserted in a transverse direction T (which is perpendicular to the forward and rearward directions) between the ferrule assemblies on the cables, to organize the ferrule assemblies into rows that correspond to the rows 64 of holes 46 in the cover. With the ferrule assemblies held by the grating 62, the grating and ferrule assemblies thereon are dropped into a rear aperture 66 of the shell 16. Finally, the cover 24 is slid forwardly along the cables until it lies substantially against the rear 70 of the shell (with a conductive gasket between them). Screws are inserted through screw holes 72, 74 in the cover and shell, to hold them securely together.

FIG. 2 illustrates a shielded cable 12 with the ferrule assembly 60 installed, and supported by the grating 62. Before the ferrule 40 is installed, the jacket 26 of the cable is trimmed away at the location 26A to leave the wires 32–34 protruding. The ferrule 40 is installed by sliding it rearwardly over the cable until a rearwardly-facing shoulder 80 of the ferrule abuts the trimmed end 26A of the cable jacket. The shield 30 of the cable has been left intact when the jacket was trimmed, and the ferrule is slid rearwardly over the shield. A rear portion 82 of the ferrule is crimped onto the cable jacket to leave a crimped portion 52 that is of reduced diameter. The shield 30 extends forwardly of the ferrule, and is wrapped back around a forward portion 84 of the ferrule. Then, the jerk ring 42 is slid rearwardly over the shield portion 30A which was wrapped rearwardly around the ferrule, and the jerk ring is crimped in place. This results in the prepared cable shown in FIG. 1 at 44.

The holes 46 (FIG. 2) in the cover have a considerable length, because the cover is formed with rearwardly projecting chimneys 86. The rear end of the ferrule fits closely within the chimney to provide a long narrow path for reducing EMI leakage, this being known in the art as a waveguide beyond cutoff. The O-ring seal 50 is installed on the ferrule by pressing the seal rearwardly, it being necessary to expand the seal to fit it over the uncrimped part 88 of the rear ferrule portion, until the seal falls into the crimped part 52 of the ferrule which it closely surrounds. The clip 56 includes a rear ring portion 90 and four tines or fingers 92 extending rearwardly from the ring portion. Each finger has an extreme rear end or tip 94 that abuts the seal 50. The clip also has a rear portion that abuts a shoulder 96 at the front end of the ferrule crimped part 52, which resists removal of the clip.

It can be seen that when the grating 62 is installed, a pair of parallel tines or beams 100, 102 of the grating lie closely on opposite sides of the installed ferrule assembly 60, and particularly on opposite sides of the jerk ring 42. The grating thereby closely positions the forward end of the ferrule to be aligned with a row of holes in the cover.

When the cover is screwed down, it presses forwardly against the seal 50, which is backed up by a seal compressing device formed by the clip 56. A rear end 104 of the clip is backed by a pair of beams 100, 102 of the grating, and the grating is backed by the conductive shell 16. The lengths of the grating beams in the forward direction F, and of the clip, are chosen so the seal 50 will be considerably compressed. As mentioned above, the seal 50 is formed of a conductive compressible material, such as rubber with particles of copper, silver or carbon, imbedded therein. When the elastomeric seal is compressed in a rearward direction, the material of the seal expands in a perpendicular direction, according to Poisson's ratio. This results in the inside 50A of the seal pressing firmly against the crimped part 52 of the ferrule to make a good EMI-tight seal therewith. Thus, the compressed seal 50 extends between the forward face 24F of the cover 24 and the crimped part 52 of the ferrule to block EMI from passing through the hole 46 in the cover. A compressible seal can be used to make contact between the cover and a cable ferrule in other ways, as by providing a flange on the ferrule that compresses the seal or by using the seal in the manner of an O-ring fluid seal. It is noted that the rear ring portion 90 of the clip has a rearwardly-facing shoulder 106 that abuts a corresponding shoulder on the ferrule, which limits compression of the seal so it will not be damaged.

Figure 4:
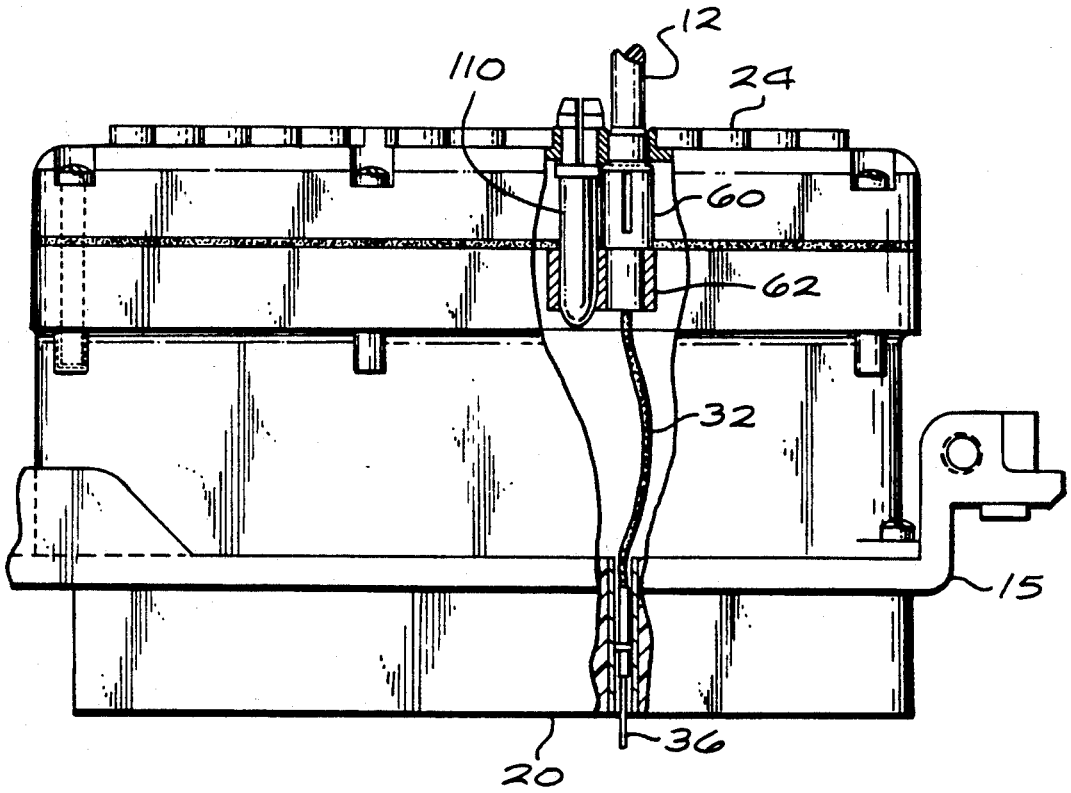
FIG. 4 is a partially sectional side view of the backshell and connector assembly of FIG. 1.
Figure 5:
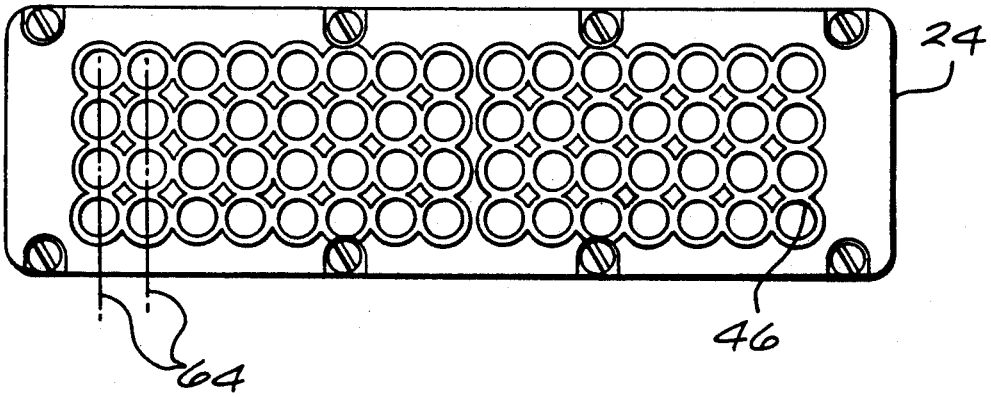
FIG. 5 is a partial rear view of the backshell assembly of FIG. 4.

FIG. 4 illustrates the fully assembled backshell assembly installed on a connector 15, showing one cable 12 with a pin contact 36 installed in the insert 20, and with the ferrule assembly 60 captured between the cover 24 and grating 62. This figure also shows a sealing plug 110 extending between the cover and grating, at a position where no cable is required.

Figure 6:
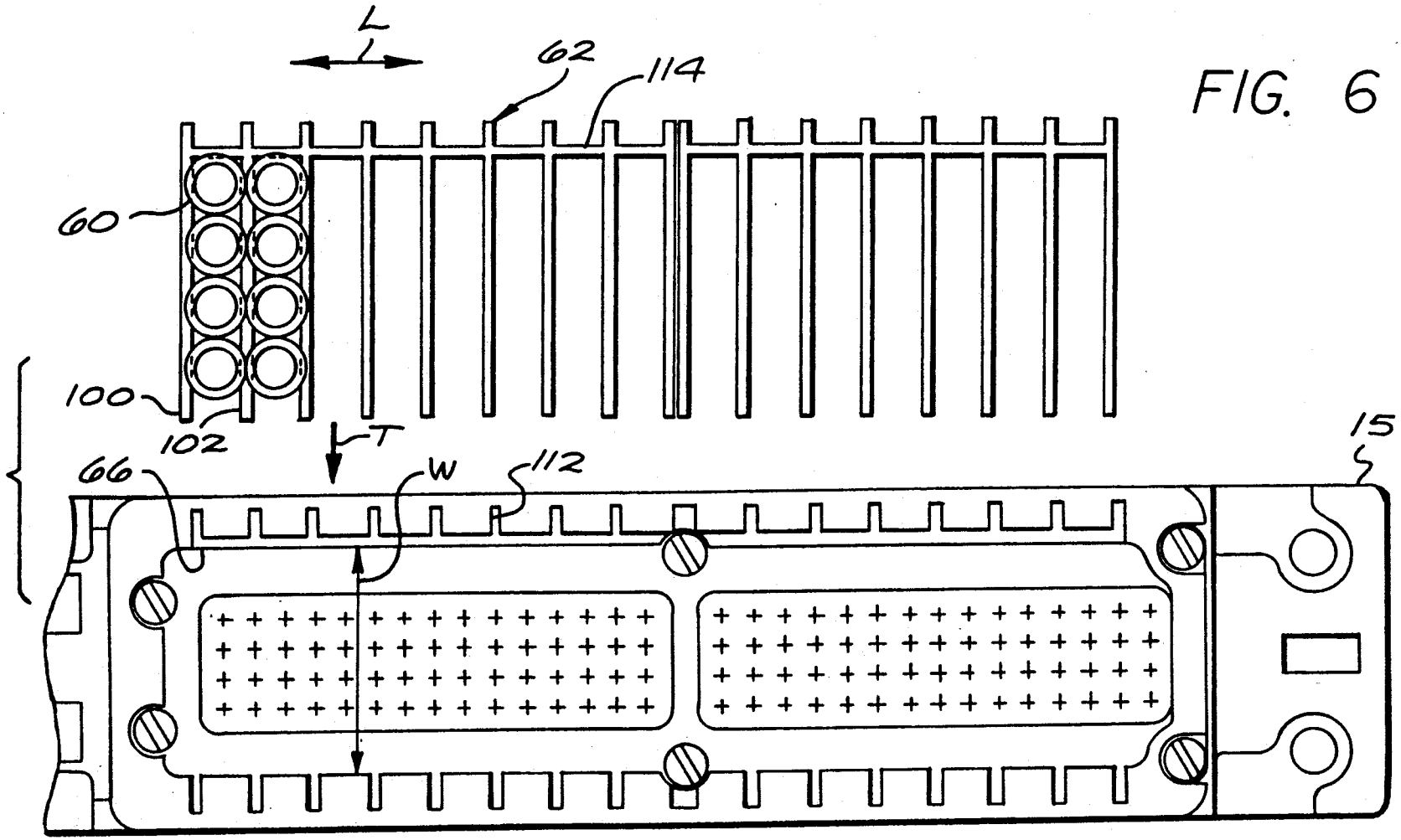
FIG. 6 is an exploded rear view of the backshell housing of FIG. 4 with the cover removed, and showing a grating not yet installed and the position of ferrule assemblies thereon.

FIG. 6 shows how the grating 62 (which can be conductive or insulative) can be used to hold ferrule assemblies 60, to arrange them in rows corresponding to the rows of holes in the cover. As mentioned above, pairs of beams 100, 102 closely surround the ferrule assemblies to position them in a longitudinal direction L. The widths of four ferrule assemblies is approximately equal to the width W of the rear aperture 66, to position the ferrule assemblies along each row containing four ferrule assemblies. It is noted that the shell aperture 66 has recesses 112 at its rearward end that closely receive and align the grating. The grating includes a cross member 114 that holds together all of the beams such as 100, 102, with the beam extending parallel to each other and being spaced apart by the same distance as the rows of holes in the cover.

Referring again to FIG. 1, if a cable or its forward portion or the ferrule assembly thereon have to be replaced, this can be relatively easily accomplished. The cover 24 is unscrewed from the back shell assembly and slid rearwardly along all of the cables. Although there is very little clearance, if any, between each ferrule rear portion 82 and the cover hole, there is a substantial clearance between the cable jacket and hole, allowing free sliding once the ferrules are out of the holes. Then, the grating 62 is removed, and contacts 36–38 are released from the insert and the cables are pulled rearwardly. Then the clip 56 is pushed forwardly to remove it and the seal 50 is pushed forwardly to remove it also. Finally, the cable with only the ferrule 40 and jerk ring 42 installed thereon is pulled rearwardly out of a hole 46 in the cover, and repairs can be made. The single repaired cable can be installed again in the reverse manner.

Thus, the invention provides a system for terminating cables, which facilitates installation of the cables and the temporary removal and reinstallation of a damaged cable end. The system includes a backshell housing having a conductive shell and a conductive cover that mounts over the rear of the shell, the cover having multiple holes each passing a cable. A ferrule assembly is installed on each cable, and includes a ferrule that holds the cable, a conductive compressible seal that surrounds the ferrule and abuts a forward end of the cover, and a seal-compressing device that is supported against forward movement and which abuts the seal to compress it. As the seal is compressed, its inside undergoes a reduction in diameter to tightly grip the ferrule and establish an EMI shield between the cover and ferrule. A grating lies between forward portions of the ferrule assemblies to organize them in rows corresponding to rows of holes in the cover. The grating can also back up the seal compressing device, or clip, which compresses the seal.

Although particular embodiments of the invention have been described and illustrated herein, it is recognized that modifications and variations may readily occur to those skilled in the art, and consequently it is intended that the claims be interpreted to cover such modifications and equivalents.

I claim:

1. A system for terminating shielded cables wherein each cable has at least one wire with a prepared end and a shield around the wire, to a backshell housing which includes a conductive shell with front and rear ends and which may hold a connector insert having terminals for mating with the prepared ends of said wires, the housing also having a conductive cover that can mount over said shell rear end, said cover having a plurality of holes that each pass one of said cables, said cover having a front side facing said shell, characterized by:

a ferrule assembly which includes a ferrule that can slide forwardly through one of said cover holes and that is crimped around said cable to form a depressed crimped region having a forward end forming a shoulder, said ferrule having a rear end with a part that projects rearwardly into one of said cover holes;

said ferrule assembly including a conductive compressible seal which closely surrounds said ferrule rear end part and abuts said cover;

said ferrule assembly including a seal-compressing device which is supported against forward movement against said housing and which compresses said seal against said cover, to cause said seal to make good electrical contact with both said cover and said ferrule assembly;

said device having a part that substantially abuts said shoulder at said forward end of said crimped region to help resist rearward movement of said ferrule.

2. A system for mounting a plurality of shielded cables that each have at least one wire with a forward end and a shield around the wire, to a backshell housing which includes a conductive shell with front and rear ends and a conductive cover that can mount over said shell rear end, said cover having a plurality of holes arranged in rows and columns that each passes one of said cables, said cover having a front side facing said shell, characterized by:

a plurality of ferrule assemblies that each surrounds and holds to one of said cable;

said backshell housing includes a grating which has a plurality of parallel beams extending parallel to the length of each of said rows, with said beams spaced by distances corresponding to the spacing of said rows of holes of said cover:

said grating being positioned with pairs of said beams lying on opposite sides of each of a group of said ferrule assemblies to confine each said group of ferrule assemblies to a position along the same row and to organize said ferrule assemblies in a plurality of rows corresponding to said rows of cover holes.

3. The system described in claim 2 wherein:

each of said ferrule assemblies includes a ferrule held to said cable, a conductive elastomeric O-ring type seal closely surrounding said ferrule and lying against said front face of said cover, and a clip having a forward portion abutting said grating and a rearward portion forming a plurality of fingers grasping said ferrule, said fingers having rear ends abutting said seal, with said grating pressing rearwardly on said clip to force said clip rearwardly to compress said seal.

4. A method for mounting a plurality of cables that each have at least one wire with a forward end and a jacket around the wire, to a backshell housing that includes a shell with front and rear ends and a cover that can mount over said shell rear end, wherein the cover has a plurality of holes arranged in a plurality of rows, that each can pass one of said cables, and wherein the cover has a front side, characterized by:

projecting each of said cables forwardly through one of said cover holes, so a forward end of the cable lies forward of the cover;

attaching a ferrule assembly around the jacket of each cable front portion to hold thereto;

inserting a grating of said backshell assembly, wherein said grating has a plurality of parallel beams, in a direction largely perpendicular to said forward direction but parallel to said rows of cover holes, so beams of said grating are inserted between groups of said ferrule assemblies and so each group of said ferrule assemblies lies between two adjacent beams of said grating, whereby to help organize said ferrule assemblies into rows.

5. A system for mounting shielded cables that each have at least one wire with a forward end and a shield around the wire, comprising:

a housing which includes a conductive shell having a rear end;

a conductive cover that can mount over said shell rear end, said cover having a plurality of holes that each passes one of said cables, said cover having a front side facing said shell;

a ferrule which surrounds and holds to said cable and which has a rear portion with a part that projects rearwardly into one of said cover holes;

a conductive elastomeric seal which closely surrounds said ferrule part and abuts said front side of said cover;

a seal-compressing device which is supported against forward movement against said housing and which presses rearwardly against said seal, to compress said seal against said front side of said cover and cause said seal to press radially inwardly against said ferrule rear end part.

6. The system described in claim 5 wherein:

said cover holes are arranged in a plurality of rows and columns;

said connector shell assembly includes a grating which has a plurality of parallel beams extending parallel to the length of each of said rows, with said beams spaced by distances correspond to the spacing of said rows of holes of said cover:

said system includes a plurality of seal compressing devices with pairs of said grating beams supporting each said seal compressing device against forward movement relative to said shell, and with a pair of said beams lying on opposite sides of each ferrule and confining each ferrule to a position along a row.

7. A system for terminating shielded cables wherein each cable has at least one wire with a prepared end and a shield around the wire, to a backshell housing which includes a conductive shell with front and rear ends and which may hold a connector insert having terminals for mating with the prepared ends of said wires, the housing also having a conductive cover that can mount over said shell rear end, said cover having a plurality of holes arranged in a plurality of rows and columns, that each pass one of said cables, said cover having a front side facing said shell, characterized by:

a ferrule assembly which includes a ferrule that surrounds and holds to said cable and which has a rear end with a part that projects rearwardly into one of said cover holes;

said ferrule assembly including a conductive compressible seal which closely surrounds said ferrule rear end part and abuts said cover;

said ferrule assembly including a seal-compressing device which is supported against forward movement against said housing and which compresses said seal against said cover, to cause said seal to make good electrical contact with both said cover and said ferrule assembly;

said housing includes a grating which has a plurality of parallel beams extending parallel to the length of each of said rows, with said beams spaced by distances corresponding to the spacing of said rows of holes of said cover;

said system includes a plurality of ferrules and a plurality of seal-compressing devices, with pairs of said grating beams supporting each of said seal compressing devices against forward movement relative to said shell.

8. A system for terminating shielded cables wherein each cable has at least one wire with a prepared end and a shield around the wire, to a backshell housing which includes a conductive shell with front and rear ends and which may hold a connector insert having terminals for mating with the prepared ends of said wires, the housing also having a conductive cover that can mount over said shell rear end, said cover having a plurality of holes that each pass one of said cables, said cover having a front side facing said shell, characterized by:

a ferrule assembly which includes a ferrule that surrounds and holds to said cable and which has a rear end with a part that projects rearwardly into one of said cover holes;

said ferrule assembly including a conductive compressible seal which closely surrounds said ferrule rear end part and abuts said cover;

said ferrule assembly including a seal-compressing device which is supported against forward movement against said housing and which compresses said seal against said cover, to cause said seal to make good electrical contact with both said cover and said ferrule assembly;

each of said ferrules has a crimped region that is crimped around one of said cables, said crimped region having a forward end forming a shoulder;

said seal compressing device includes a clip having a forward ring portion and a plurality of resilient arms extending rearwardly from said ring portion, each arm having a rear tip abutting said seal and a radially inner surface that can abut said ferrule shoulder to resist removal of the clip.

9. The system described in claim 8 wherein:

said cable has an insulative jacket which has been trimmed;

each said ferrule assemblies has an inwardly stepped region which abuts the forward end of said cable jacket and which forms a forwardly-facing shoulder;

said ring portion of said clip has an inwardly stepped forward end that abuts said ferrule assembly forwardly-facing shoulder, to limit the amount of compression of said seal.

10. A system for terminating shielded cables wherein each cable has at least one wire with a prepared end and a shield around the wire, to a backshell housing which includes a conductive shell with front and rear ends and which may hold a connector insert having terminals for mating with the prepared ends of said wires, the housing also having a conductive cover that can mount over said shell rear end, said cover having a plurality of holes that each pass one of said cables, said cover having a front side facing said shell, characterized by:

a ferrule assembly which includes a ferrule that surrounds and holds to said cable and which has a rear end with a part that projects rearwardly into one of said cover holes;

said ferrule assembly including a conductive compressible seal which closely surrounds said ferrule rear end part and abuts said cover;

said ferrule assembly including a seal-compressing device which is supported against forward movement against said housing and which compresses said seal against said cover, to cause said seal to make good electrical contact with both said cover and said ferrule assembly;

each of said ferrules has a crimped region that is crimped around one of said cables, said crimped region being of smaller outside diameter than portions of said ferrule lying immediately forward of said crimped region;

said seal is substantially an O-ring of smaller inside diameter than the ferrule portion lying immediately forward of said ferrule crimped region, whereby the O-ring must be expanded to fit in said crimped region and then resists removal.

11. A system for terminating shielded cables wherein each cable has at least one wire with a prepared end and a shield around the wire, to a backshell housing which includes a conductive shell with front and rear ends and which may hold a connector insert having terminals for mating with the prepared ends of said wires, the housing also having a conductive cover that can mount over said shell rear end, said cover having a plurality of holes that each passes one of said cables, said cover having a front side facing said shell, characterized by:

a ferrule assembly which includes a ferrule that surrounds and holds to said cable and which has a rear end with a part that projects rearwardly into one of said cover holes;

said ferrule assembly including a conductive compressible seal which closely surrounds said ferrule rear end part and abuts said cover;

said ferrule assembly including a seal-compressing device which is supported against forward movement against said housing and which compresses said seal against said cover, to cause said seal to make good electrical contact with both said cover and said ferrule assembly;

said cables each have an insulative jacket, a conductive shield within said jacket, and at least one wire within said shell, with said wire including a conductor and a wire insulation around the wire;

said jacket is trimmed so its forward end lies rearward of each said ferrule front portion, said shield extending within said ferrule front portion and said shield being wrapped around the extreme front end of said ferrule and extending rearwardly along the outside of said ferrule front portion;

said ferrule assembly includes a jerk ring which is crimped around the portion of said shield that lies around said ferrule front portion, to hold said shield wrapped about said ferrule.

12. A method for mounting a plurality of shielded cables that each have at least one wire with an end, a shield around the wire, and a jacket around the shield, to a backshell housing that includes a conductive shell with front and rear ends and that may hold a connector insert having a plurality of terminals for mating with said ends of said wires, and that also includes a conductive cover that can mount over said shell rear end, wherein the cover has a plurality of holes arranged in a plurality of rows wherein each hole can pass one of said cables, and wherein the cover has a front side, characterized by:

crimping a ferrule around the jacket of each cable front portion;

projecting each of said cables forwardly through one of said cover holes, so a front end portion of the cable lies forward of the cover;

forcing a conductive compressible O-ring type seal rearwardly around each of said ferrules until each of said seals lies closely around the crimped portion of the ferrule;

moving said cover forwardly and mounting it on said shell, while allowing a portion of said housing to press rearwardly towards said seals to cause said seals to be compressed against the front side of said cover and the outside of the crimped portions of said ferrules; and inserting a grating of said housing, wherein said grating has a plurality of parallel beams, so beams of said grating are inserted between forward portions of said ferrules with a plurality of said ferrules lying between two adjacent beams of said grating, whereby to organize said ferrules into rows; wherein said step of moving said cover forwardly while allowing a portion of said housing to press rearwardly toward said seals, includes allowing said grating to press forwardly against a seal-compressing device that has a rear end abutting said seal.

13. The method described in claim 12 wherein said seal-compressing device comprises a clip, and including:

inserting a clip on each of a plurality of said ferrules after forcing said seals around said ferrules, and said step of moving said cover forwardly while allowing a portion of said housing to press rearwardly against said seals, includes compressing said clips between said grating and said seals.

* * * * *